US006969225B2

(12) United States Patent
Mensch

(10) Patent No.: US 6,969,225 B2
(45) Date of Patent: Nov. 29, 2005

(54) LOADER ATTACHMENT

(76) Inventor: Donald L. Mensch, 2449 S. Highway M-37, Hastings, MI (US) 49058

( * ) Notice: Subject to any disclaimer, the term of this patent is extended or adjusted under 35 U.S.C. 154(b) by 0 days.

(21) Appl. No.: 10/418,785

(22) Filed: Apr. 18, 2003

(65) Prior Publication Data

US 2004/0208736 A1 Oct. 21, 2004

(51) Int. Cl.[7] ..... B66C 3/00

(52) U.S. Cl. ..... 414/685; 187/237; 414/664; 414/667

(58) Field of Search ..... 414/667, 664, 414/668, 671, 785, 685, 722; 187/237, 222; 294/120, 67.31

(56) References Cited

U.S. PATENT DOCUMENTS

| | | | | |
|---|---|---|---|---|
| 2,886,197 A | | 5/1959 | Harris | |
| 3,223,267 A | | 12/1965 | Stammen | |
| 3,342,361 A | | 9/1967 | Melin | |
| 3,543,959 A | | 12/1970 | Stammen | |
| 3,672,525 A | | 6/1972 | Schaedler | |
| 4,049,140 A | | 9/1977 | Roose | |
| 4,381,166 A | | 4/1983 | Smart | |
| 4,392,773 A | * | 7/1983 | Johannson | 414/667 |
| 4,402,645 A | | 9/1983 | Broderick et al. | |
| 4,756,661 A | | 7/1988 | Smart | |
| 4,903,418 A | | 2/1990 | Loudon | |
| 5,081,941 A | | 1/1992 | Weeks | |
| 5,328,223 A | | 7/1994 | Maggio | |
| 5,374,156 A | | 12/1994 | Simpson et al. | |
| 5,669,750 A | | 9/1997 | Vieselmeyer | |
| 5,688,102 A | | 11/1997 | Vieselmeyer | |
| 6,336,784 B1 | * | 1/2002 | Monaghan | 414/685 |
| 6,394,732 B1 | * | 5/2002 | Sweezey | 414/24.6 |

* cited by examiner

*Primary Examiner*—Donald W. Underwood
(74) *Attorney, Agent, or Firm*—Price, Heneveld, Cooper, DeWitt & Litton LLP

(57) ABSTRACT

A loader attachment including a frame having a left sidewall and a right sidewall. The loader attachment also includes a first track with a tine slidably coupled to the first track, a second track with a tine slidably coupled to the second track, a first actuator mounted on the right sidewall of the frame for initiating sliding of the first tine along the first track toward and away from the left sidewall, and a second actuator mounted on the left sidewall of the frame for initiating sliding of the second tine along the second track toward and away from the right sidewall of the frame.

13 Claims, 4 Drawing Sheets

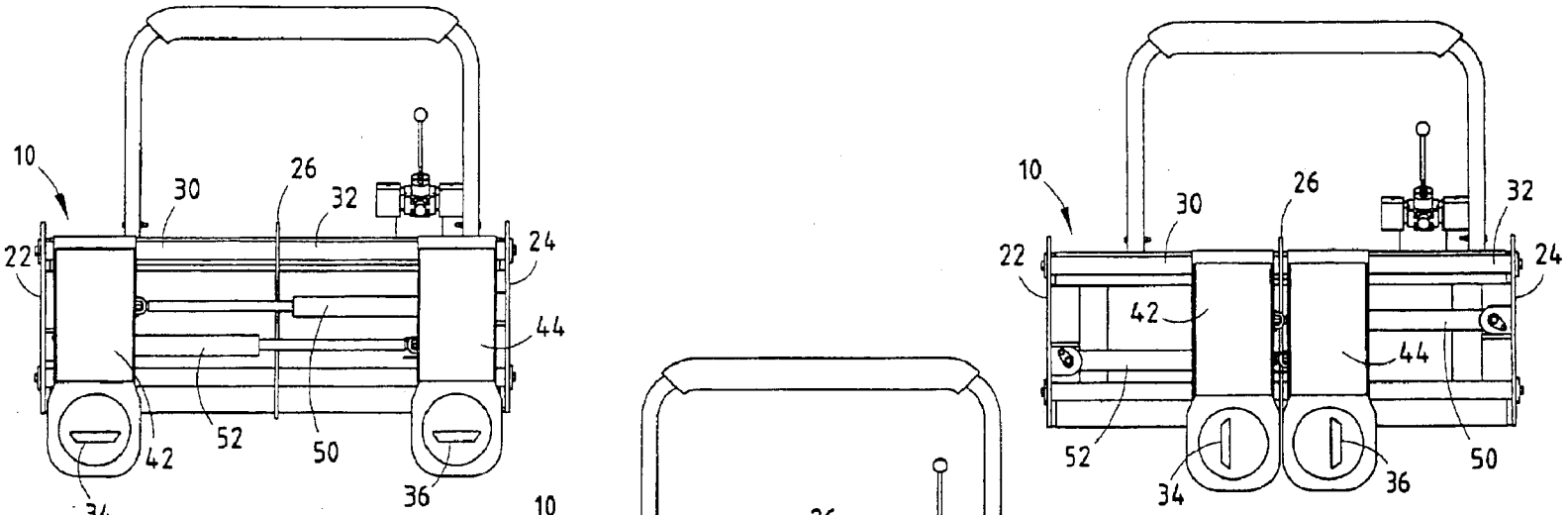
FIG. 3A
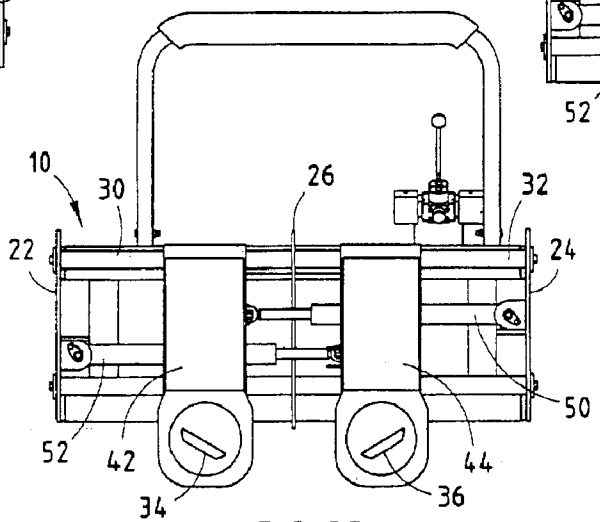
FIG. 3B
FIG. 3C

LOADER ATTACHMENT

BACKGROUND OF THE INVENTION

The present invention generally relates to an improved loader attachment adapted for attachment to a front loader vehicle having a lift mechanism. Such a loader attachment is useful in landscaping, e.g., for planting and removing trees, and for working with pallets.

Landscapers are often required to move large objects, such as trees, large plants, and rocks. Because of the size of these objects, landscapers frequently use a front loader vehicle to assist in moving these objects. Rather than purchasing a loading vehicle specifically designed for landscaping, it is more economical for a landscaper to use a loader attachment coupled to a conventional loader vehicle. Such a loader attachment is most effective if it (a) can readily adapt to different sized and different shaped objects; (b) remains stable during movement; and (c) is made from a simple configuration of parts.

Current loader attachments use complicated arrangements of parts in order to adapt to different sized and shaped objects. Examples of such devices are disclosed in Vieselmeyer U.S. Pat. No. 4,688,102 and Vieselmeyer U.S. Pat. No. 5,669,750. Vieselmeyer U.S. Pat. No. 4,688,102 has one tine secured at a first end of a loader attachment, allows movement of a second tine laterally toward and away from the first tine, and also allows movement of the second tine at an angle relative to the first tine. With movement of the second tine, the object being lifted is not centered relative to the loader vehicle or the loader attachment and the loader vehicle is not stable and is at risk of tipping. Further, when the second tine is angled relative to the first tine, the object being lifted may not be securely grasped between the two tines.

Vieselmeyer U.S. Pat. No. 5,669,750 discloses a loader attachment having two tines, each of which is coupled to an arm and which arms each are pivotally connected at an upper end to a frame. Further, the arms are interconnected by a parallelogram linkage to maintain the orientation of the tines on the arms as the arms are pivoted. Such a loader attachment utilizes a complicated and expensive combination of parts in an effort to always maintain the tines in parallel orientation to each other throughout movement of the tines.

SUMMARY OF THE INVENTION

The present invention is an improvement over current loader attachments because it is a structurally simple and cost-effective construction of parts permitting adjustment to accommodate moving a large variety of different sized and shaped objects. Further, the present invention operates while maintaining balance of the tines about the center of the loader attachment, while also maintaining a parallel relationship along the length of the tines. To achieve these and other advantages, and in accordance with the purpose of the invention as embodied and broadly described herein, the present invention provides a loader attachment having a frame including a left sidewall and a right sidewall; a first track; a second track; a first tine that is slidably coupled to the first track; a second tine that is slidably coupled to the second track; a first actuator mounted on the right sidewall of the frame for initiating sliding of the first tine along the first track toward and away from the left sidewall of the frame; and a second actuator mounted on the left sidewall of the frame for initiating sliding of the second tine along the second track toward and away from the right sidewall of the frame.

In another embodiment of the present invention, the loader attachment includes a frame; a first tine having a length, a first cross section, and a first longitudinal axis that is parallel to the length of the first tine; and a second tine having a length, a second cross section, and a second longitudinal axis that is parallel to the length of the second tine; wherein the first tine is rotatable about the first longitudinal axis and proximate the first cross section of the first tine; and wherein the second tine is rotatable about the second longitudinal axis and proximate the second cross section of the tine.

These and other features, objects, and benefits of the invention will be recognized by those who practice the invention and by those skilled in the art, from reading the following specification and claims, together with reference to the accompanying drawings.

BRIEF DESCRIPTION OF THE DRAWINGS

In the drawings,

FIG. 3A is a front elevational view of the present invention showing the tine supports in a first tine support position and the tines in a first tine position;

FIG. 3B is a front elevational view of the present invention showing the tine supports in a second tine support position and the tines in a second tine position;

FIG. 3C is a front elevational view of the present invention showing the tine supports in a third tine support position and the tines in a third tine position;

DETAILED DESCRIPTION OF PREFERRED EMBODIMENT

Figure 1:
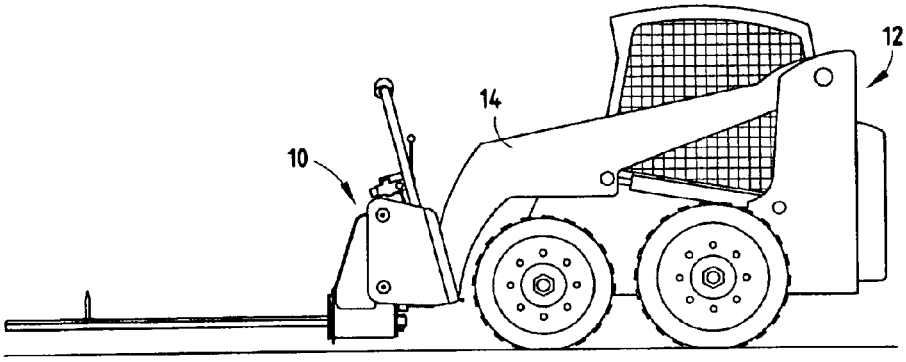
FIG. 1 is an elevational view of the loader attachment of the present invention mounted on a loading vehicle.
Figure 2:
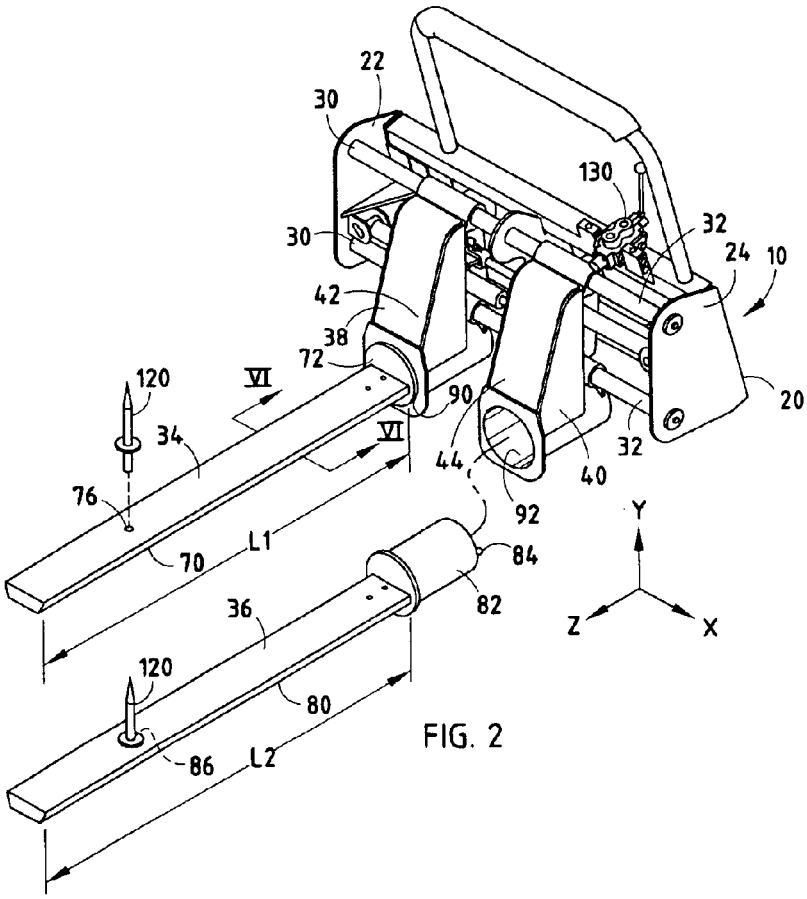
FIG. 2 is a perspective view of the present invention.

FIG. 1 shows loader attachment 10 attached to a front loader vehicle 12. Conventional loader vehicles, such as loader vehicle 12, include lift mechanism 14 for raising and lowering a loader attachment or bucket. Referring to FIG. 2, lift mechanism 14 of loader 12 is used to raise and lower loader attachment 10 along a Y axis.

Loader attachment 10 includes a frame 20 that is configured for attachment to lift mechanism 14 of loader 12 and that has sufficient structural integrity for coupling to lift mechanism 14 of loader 12. The manner of securing loader attachment 10 to loader 12 is well-known to those of ordinary skill in the art and, accordingly, is not shown. Frame 20 includes a left sidewall 22, a right sidewall 24, and a vertical centerpiece 26 which is equidistant between left sidewall 22 and right sidewall 24 (FIGS. 3A–3C).

Referring to FIG. 2, loader attachment 10 also includes first laterally oriented horizontal bars 30 and second laterally oriented horizontal bars 32. First laterally oriented horizontal bars 30 are attached to left sidewall 22 and extend perpendicularly from left sidewall 22 to vertical centerpiece 26. Second laterally oriented horizontal bars 32 are attached to right sidewall 24 and extend perpendicularly from right sidewall 24 to vertical centerpiece 26.

Loader attachment 10 further includes a first tine subassembly 42 slidably coupled to first laterally oriented horizontal bars 30 and a second tine subassembly 44 slidably coupled to second laterally oriented horizontal bars 32. First tine subassembly 42 includes a first tine 34 and a first tine support 38. First tine subassembly 42 is coupled to first laterally oriented horizontal bars 30 by first tine support 38. Second tine subassembly 44 includes a second tine 36 and a second tine support 40. Second subassembly 44 is coupled to second laterally oriented horizontal bars 32 by second tine support 40 (FIG. 2). First tine support 38 is laterally slidable to an infinite number of positions between left sidewall 22 of frame 20 and centerpiece 26 of frame 20. Second tine support 40 is laterally slidable on the opposite side of centerpiece 26 of frame 20 to an infinite number of positions between right sidewall 24 of frame 20 and centerline 26 of frame 20. First tine subassembly 42 and second tine subassembly 44 are positionable at equal distances from centerpiece 26 of frame 20. So positioned, loader attachment 10 is well-balanced about centerpiece 26 of frame 20.

Sliding of first tine subassembly 42 is initiated by a first actuator 50 of loader attachment 10, and sliding of second subassembly 44 is initiated by second actuator 52 of loader attachment 10. First actuator 50 and second actuator 52 may either be linked or may be independently actuated. First actuator 50 is mounted on left sidewall 22 of frame 20 and extends perpendicularly therefrom. Second actuator 52 is mounted on right sidewall 24 of frame 20 and extends perpendicularly therefrom. First actuator 50 and second actuator 52 initiate sliding of first tine subassembly 42 and second tine subassembly 44, respectively, along an X axis (FIG. 2). First tine subassembly 42 and second tine subassembly 44 can be moved toward and away from each other along the X axis to accommodate the various sized objects that need to be lifted or moved. During such movement, first tine 34 and second tine 36 remain parallel to each other, thereby contacting their greatest surface areas with the object being moved.

Figure 4C:
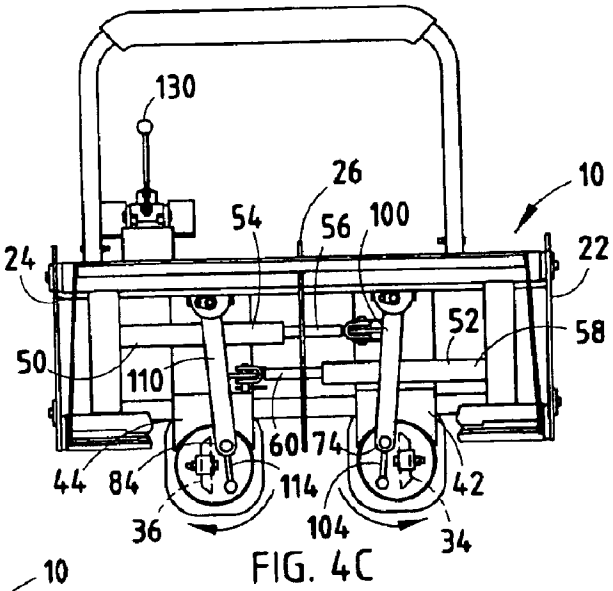
FIG. 4C is a rear elevational view of the present invention showing the tines in the third tine position (with a lower portion of the frame cutaway)
Figure 4B:
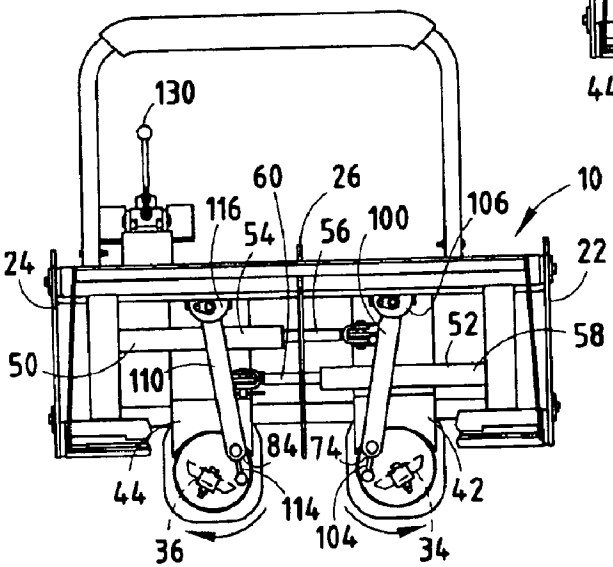
FIG. 4B is a rear elevational view of the present invention showing the tines in the second tine position (with a lower portion of the frame cutaway)
Figure 4A:
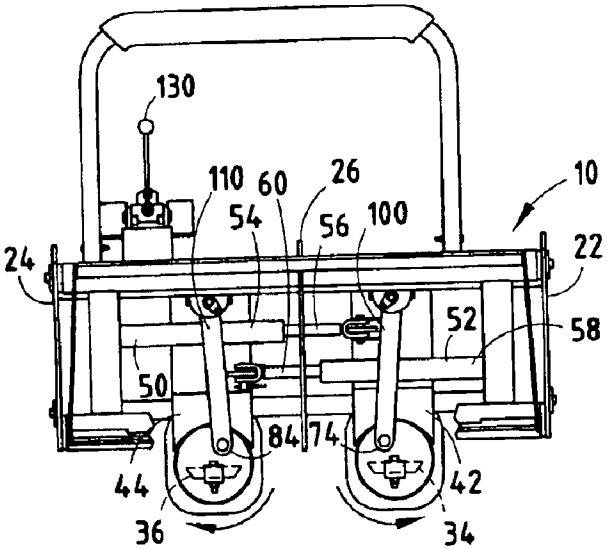
FIG. 4A is a rear elevational view of the present invention showing the tines in the first tine position (with a lower portion of the frame cutaway)

First actuator 50 includes a cylinder 54 and a rod 56, and second actuator 52 includes a cylinder 58 and a rod 60 (FIGS. 4A–4C). As first tine subassembly 42 is moved from a position adjacent left sidewall 22 of frame 20 toward centerpiece 26, rod 56 of first actuator 50 is retracted into cylinder 54 of first actuator 50 (FIGS. 3A and 3B). As first tine subassembly 42 is moved toward left sidewall 22 of frame 20 and away from centerpiece 26, rod 56 of first actuator 50 is extended from cylinder 54 of first actuator 50. Similarly, as second tine subassembly 44 is moved away from right sidewall 24 of frame 20 and toward centerpiece 26 of frame 20, rod 60 of second actuator 52 is retracted into cylinder 58 of second actuator 52 (FIGS. 3A and 3B). As second tine subassembly 44 is moved toward right sidewall 24 of frame 20 and away from centerpiece 26, rod 60 of second actuator 52 is extended from cylinder 58 of second actuator 52. FIG. 3C depicts rod 56 of first actuator 50 and rod 60 of second actuator 52 in their fully retracted positions. FIG. 3A depicts rod 56 of first actuator 50 and rod 60 of second actuator 52 in their fully extended positions. FIG. 3B depicts rod 56 of first actuator 50 and rod 60 of second actuator 52 in a partially extended position. As rod 56 and rod 60 are extended or retracted from cylinder 54 and cylinder 58, respectively, first tine subassembly 42 and second tine subassembly 44, respectively, move along the X axis (FIG. 2).

First tine 34 includes a bottom face 70, a cylindrical insert 72, a first protrusion 74 extending rearwardly from cylindrical insert 72, and an aperture 76. Second tine 36 includes a bottom face 80, a cylindrical insert 82, a second offset protrusion 84 extending rearwardly from cylindrical insert 82, and an aperture 86. First tine 34 has a length L1 and a longitudinal axis A1. Second tine 36 has a length L2 and a longitudinal axis A2. Axes A1 and A2 are parallel to length L1 of first tine 34 and length L2 of second tine 36, respectively, and also are parallel to a Z axis (as shown in FIG. 2).

First tine subassembly 42 also includes third actuator 100, having a cylinder 102 and a rod 104. Second tine subassembly 44 also includes a fourth actuator 110, having a cylinder 112 and a rod 114. Third actuator 100 is connected at one end to first tine support 38 by a bracket 106 and at the other end to first offset protrusion 74 of cylindrical insert 72 of first tine 34. Similarly, fourth actuator 110 is connected at one end to second tine support 40 by a bracket 116 and the other end to second offset protrusion 84 of cylindrical insert 82 of second tine 36. As shown in FIGS. 4A–4C, upon extension or retraction of rod 104 relative to cylinder 102 first offset protrusion 74 is moved and, consequently, rotates cylindrical insert 72 of first tine 34 within a forward-facing cylindrical aperture 90 of first tine support 38. Similarly, upon extension or retraction of rod 114 relative to cylinder 112, second offset protrusion 84 is moved and, consequently, rotates cylindrical insert 82 of second tine 36 within a forward-facing aperture 92 of second tine support 40.

Figure 6:
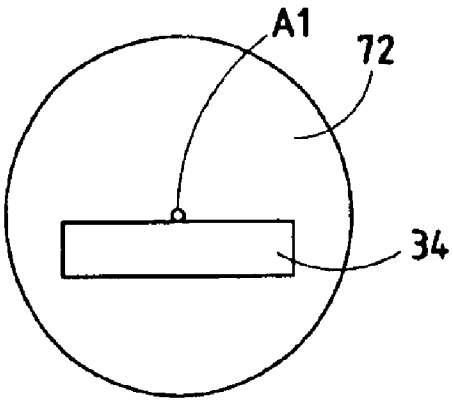
FIG. 6 is a cross section taken along lines VI—VI of FIG. 2.
Figure 5:
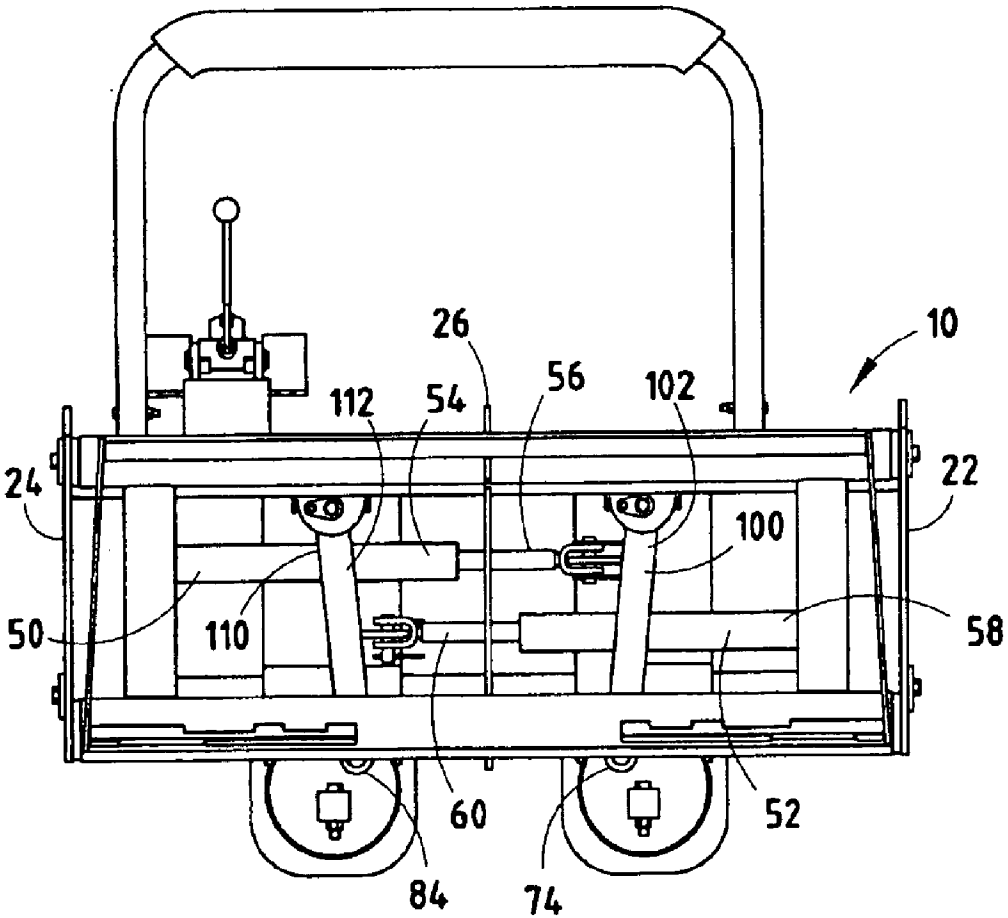
FIG. 5 is a rear elevational view of the present invention showing the tine supports in the second tine support position.

From an initial position (FIG. 4A), first tine 34 can be rotated about 90° within forward-facing aperture 90 and second tine 36 can be rotated about 90° within forward-facing aperture 92 (FIG. 4C). Within the 90° range of movement, first tine 34 and second tine 36 each are rotatable to an infinite number of positions. For example, first tine 34 and second tine 36 can be rotated such that bottom face 70 of first tine 34 and bottom face 80 of second tine 36 face away from each other (FIG. 4C). First tine 34 is rotated within forward facing cylindrical aperture 90 about longitudinal axis A1 and within or proximate (a few inches from) a cross section of tine 34 (FIG. 6). Second tine 36, similarly, is rotated about longitudinal axis A2 and within or proximate (a few inches from) a cross section of second tine 36. By rotation of first tine 34 and second tine 36 within or proximate their respective cross sections, third actuator 100 and fourth actuator 110 cause the direct rotation of first tine 34 and second tine 36 using a minimal expenditure of energy and a limited number of parts.

Additionally, loader attachment 10 includes removable spikes 120 that are sized and configured to engage aperture 76 of first tine 34 and aperture 86 of second tine 36 (FIG. 2). Spikes 120 can be utilized to grasp soft objects, such as the root ball of a tree, to assist in securely moving the object. For example, a spike 120 can be inserted into aperture 76 and extending perpendicularly from first tine 34, a spike 120 can be inserted into aperture 86 and extending perpendicularly from second tine 36, and first tine 34 and second tine 36 can be positioned facing each other (as shown in FIG. 4C). So positioned, first actuator 50 and second actuator 52 can be actuated to laterally move first tine subassembly 42 toward second tine subassembly 44 and laterally move second tine subassembly 44 toward first tine subassembly 42 thereby trapping an object on spikes 120 between first tine 34 and second tine 36. Then, third actuator 100 and fourth actuator 110 (respectively) can be rotated (as shown in FIG. 4B). Then, lift mechanism 14 of loader 12 can be activated to lift and move the object. Upon reaching the final location for the object, lift mechanism 14 can be actuated to lower the object, third actuator 100 and fourth actuator 110 (respectively) can be actuated to rotate first tine 34 and second tine 36 from the tine positions shown in FIG. 4B toward the tine positions in FIG. 4C, allowing the object to be gently released into its final location.

Loader attachment 10 also includes a controller 130 to control first actuator 50, second actuator 52, third actuator 100, and fourth actuator 110.

Because of the variable positioning of first tine subassembly 42 along first laterally oriented horizontal bars 30, of second tine subassembly 44 along second laterally oriented horizontal bars 32, of first tine 34 within forward facing aperture 90 of first tine support 38 and, of second tine 36 within forward facing aperture 92 of second tine support 40, the present invention is remarkably efficient in adjusting to accommodate objects of many sizes and configurations.

It will be appreciated by those of ordinary skill in the art that the present invention can be applied to a wide variety of loader attachments in addition to those specifically mentioned here.

It will be understood by those who practice the invention and those of ordinary skill in the art that various modifications and improvements may be made to the invention without departing from the spirit of the disclosed concept. The scope of protection afforded is to be determined by the claims and by the breadth of interpretation allowed by law.

The invention claimed is:

1. A loader attachment, comprising:

a frame having a left sidewall and a right sidewall;

a first track;

a second track;

a first rotatable tine slidably coupled to said first track, said first tine having a length;

a second rotatable tine slidably coupled to said second track, said second tine having a length;

a first actuator mounted on said right sidewall of said frame for initiating sliding of said first tine along said first track toward and away from said left sidewall of said frame;

a second actuator mounted on said left sidewall of said frame for initiating sliding of said second tine along said second track toward and away from said right sidewall of said frame;

a first tine support slidably mounted on the first track for rotatably supporting said first rotatable tine; and a second tine support slidably mounted on the second track for rotatably supporting said second rotatable tine;

wherein said first tine support and said second tine support each include a forward-facing aperture, said first rotatable tine includes a first insert sized and configured to be rotatably supported within said forward-facing aperture of said first tine support, and said second rotatable tine includes a second insert sized and configured to be rotatably supported within said forward-facing aperture of said second tine support.

2. The loader attachment of claim 1, wherein said frame has a centerline between said left sidewall of said frame and said right sidewall of said frame, said first track spans a distance from about said centerline to about said left sidewall of said frame, and said second track spans a distance from about said centerline to about said right sidewall of said frame.

3. The loader attachment of claim 1, wherein said first actuator can be actuated independently from said second actuator.

4. The loader attachment of claim 2, wherein said first tine is slidable along said first track and said second tine is slidable along said second track such that, during sliding of said first and second tines, said first tine and said second tine remain generally equidistantly spaced about said centerline of said backwall.

5. The load attachment of claim 2, wherein said first tine has a longitudinal axis parallel to said length of said first tine, said second tine has a longitudinal axis parallel to said length of said second tine, said first tine is slidable along said first track, and said second tine is slidable along said second track such that during said sliding of said first tine and said second tine said longitudinal axis of said first tine remains parallel to said longitudinal axis of said second tine.

6. The loader attachment of claim 1, wherein said first tine and said second tine each include an aperture sized and configured to receive a rod, and further comprising:

a first rod sized and configured to mate with said aperture of said first tine and to extend perpendicularly from said first tine; and a second rod sized and configured to mate with said aperture of said second tine and to extend perpendicularly from said second tine.

7. A loader attachment comprising:

a frame;

a first tine having a length, a first cross section, and a first longitudinal axis that is parallel to said length of said first tine, wherein said first tine is rotatable about said first longitudinal axis to an infinite number of positions and said first longitudinal axis is located proximate said first cross section of said first tine;

a second tine having a length, a second cross section, and a second longitudinal axis that is parallel to said length of said second tine, wherein said second tine is rotatable about said second longitudinal axis to an infinite number of positions and said second longitudinal axis is located proximate said second cross section of said second tine; and actuators for moving said first and second tines to a selected one of their respective infinite numbers of positions.

8. The loader attachment of claim 7, wherein said first tine and said second tine each include an aperture sized and configured to receive a rod, and further comprising:

a first rod sized and configured to mate with said aperture of said first tine and to extend perpendicularly from said first tine; and a second rod sized and configured to mate with said aperture of said second tine and to extend perpendicularly from said second tine.

9. The loader attachment of claim 7, wherein said first tine and said second tine each are rotatable from a starting position to a final angled position that is 90° from said starting position.

10. A loader attachment adapted for attachment to a front-loader vehicle having a lift mechanism, comprising:

a frame configured for attachment to the lift mechanism of the front-loader vehicle, said frame including a right sidewall, a left sidewall, a first laterally oriented horizontal bar, and a second laterally oriented horizontal bar;

a first tine slidably mounted on said first laterally oriented horizontal bar;

a second tine slidably mounted on said second laterally oriented horizontal bar;

a first actuator for initiating sliding of said first tine along said first laterally oriented horizontal bar;

a second actuator for initiating sliding of said second tine along said second laterally oriented horizontal bar;

wherein said first actuator is mounted on said right sidewall of said frame for initiating sliding of said first tine along said first laterally oriented horizontal bar toward and away from said left sidewall of said frame;

said second actuator is mounted on said left sidewall of said frame for initiating sliding of said second tine along said second laterally oriented horizontal bar toward and away from said right sidewall of said frame;

a first tine support for supporting said first tine; and a second tine support for supporting said second tine;

wherein said first actuator includes a cylinder-rod assembly connected from said right sidewall of said frame to said first tine support, and said second actuator includes a cylinder-rod assembly connected from said left sidewall of said frame to said second tine support;

wherein further said first tine support and said second tine support each include a forward-facing aperture, said first tine includes a length and a first insert sized and configured to be rotatably supported within said forward-facing aperture of said first tine support, and said second tine includes a length and second insert sized and configured to be rotatably supported within said forward-facing aperture of said second tine support.

11. The loader attachment of claim 10 further comprising:

a third actuator, and a fourth actuator, wherein said first insert of said first tine includes a first offset protrusion extending rearwardly from said first tine, said second insert of said second tine includes a second offset protrusion extending rearwardly from said second tine, said third actuator is connected between said first tine support and said first offset protrusion for rotating said first tine about a longitudinal axis that extends parallel to said length of said first tine, and said fourth actuator is connected between said second tine support and said second offset protrusion for rotating said second tine about a longitudinal axis that extends parallel to said length of said second tine.

12. The loader attachment of claim 11, wherein said first tine is rotatable from an initial position to a final angled position 90° from said initial position of said first tine, and said second tine is rotatable from an initial position to a final angled position 90° from said initial position of said second tine.

13. A loader attachment comprising:

a frame;

a first tine having a length;

a second tine having a length;

a first tine support for supporting said first tine; and a second tine support for supporting said second tine;

wherein said first tine support and said second tine support each include a forward-facing aperture, said first tine includes a first insert sized and configured to be rotatably supported within said forward-facing aperture of said first tine support, and said second tine includes a second insert sized and configured to be rotatably supported within said forward-facing aperture of said second tine support.

* * * * *